US005427847A

United States Patent [19]

Zawada

[11] Patent Number: 5,427,847

[45] Date of Patent: Jun. 27, 1995

[54] RECEPTOR SHEET USING LOW GLASS TRANSITION COATING

[75] Inventor: Robert C. Zawada, Belchertown, Mass.

[73] Assignee: Rexham Graphics Inc., South Hadley, Mass.

[21] Appl. No.: 63,697

[22] Filed: May 20, 1993

[51] Int. Cl.[6] ..... B41M 5/00

[52] U.S. Cl. ..... 428/331; 156/234; 428/195; 428/423.1; 428/484; 428/500; 428/913; 428/914

[58] Field of Search ..... 428/195.9 B, 484, 488.1, 428/500, 331, 423.1, 914; 156/234

[56] References Cited

U.S. PATENT DOCUMENTS

| | | | |
|---|---|---|---|
| 3,060,023 | 10/1962 | Burg et al. | 156/234 |
| 3,083,132 | 3/1963 | Miehle | 156/234 |
| 3,157,547 | 11/1964 | Newman | 156/234 |
| 4,273,602 | 6/1981 | Kosaka et al. | 156/234 |
| 4,678,687 | 7/1987 | Malhotra | 428/195 |
| 4,686,549 | 8/1987 | Williams et al. | 503/227 |
| 4,876,235 | 10/1989 | DeBoer | 503/227 |
| 4,958,173 | 9/1990 | Fitch et al. | 430/39 |
| 4,992,304 | 2/1991 | Titterington | 427/164 |
| 5,169,468 | 12/1992 | Royce et al. | 156/234 |

OTHER PUBLICATIONS

Abe et al., "Relation between Dynamic Characteristics of Thermo-Fusible Ink and Print Quality in Thermal Transfer Printing," Journal of Imaging Technology, vol. 17, No. 3, Jun./Jul. 1991.

*Primary Examiner*—Pamela R. Schwartz
*Attorney, Agent, or Firm*—Burns, Doane, Swecker & Mathis

[57] ABSTRACT

Provided is a receptor sheet tier receiving donor material in imagewise fashion by means of mass transfer printing. The receptor sheet has a substrate having a wax coating with a glass transition temperature below about 25° C. The coating may also contain a polymeric material and/or silica. Such receptor sheets provide excellent print quality in high speed printers.

Also provided is donor sheet-receptor sheet system, a method of forming the receptor sheet of the invention, and a method for forming an image on the receptor sheet of the invention.

19 Claims, No Drawings

RECEPTOR SHEET USING LOW GLASS TRANSITION COATING

FIELD OF THE INVENTION

The present invention lies in the art of mass transfer printing. More specifically the invention concerns a method and composition for a receptor sheet for wax thermal transfer printing having improved wax receptivity for better resolution and a reduced tendency to jam the printing mechanism.

BACKGROUND OF THE INVENTION

Thermal mass transfer printing employs a donor sheet-receptor sheet system, whereby a thermal print head applies heat to the backside of a donor sheet in selective imagewise fashion. The images are transferred to the receptor sheet either by chemical reaction with, or mass transfer from, the donor sheet. Mass transfer systems provide for the transfer of colored material directly from the donor to the receptor sheet, with no color-forming chemical reaction occurring.

In wax thermal (mass) transfer printing, an ink or other record-forming material in admixture with a wax compound is transferred from a donor material such as a carder ribbon to a receptor sheet by applying heat to localized areas of the carrier. The wax/ink mixture on the carrier ribbon melts or softens, preferentially adhering to the receptor sheet, which may be either paper or transparent film. In the case of paper, the receptor sheet has more surface roughness than does the carrier, so ink transfer is largely achieved by a physical interlocking of the softened wax and ink with the paper fibers.

The transfer of a marking material to a receptor sheet film such as transparent polyester, differs in that the surface of the film is very smooth. Here, wetting of the film surface by the softened wax/ink mixture must be adequate in order to provide preferential adhesion of the wax/ink mixture to the receptor rather than to the donor sheet. The transfer of single pixel dots is particularly sensitive to differences in adhesion because some of the heat input at the individual dot is dissipated into the surrounding ink mass, decreasing the temperature of the dot and lessening its ability to transfer.

A number of polymeric coatings placed on the receptor sheet have been claimed to improve ink transfer, including polyester, polycarbonate, polyamide, urea, and polyacrylonitrile resins, saturated polyester resins, stearamide, and poly(alkylvinylethers), poly(meth)acrylic esters, polymethylvinylketone, polyvinylacetate, and polyvinylbutyral. In general, these polymeric coatings have a somewhat higher degree of adhesiveness than the transparent film substrate. This accounts for an increased receptivity of the coating as compared to the substrate. Heat transfer from the printing head to the coating increases adhesiveness even further.

Examples of this type of coating are disclosed in U.S. Pat. No. 4,678,687, issued to Xerox Corporation, which relates to thermal transfer printing sheets useful as transparencies wherein a polymeric coating is applied to a receptor substrate. The coating can be a poly(vinylether), poly(acrylic acid ester), poly(methacrylic acid ester), poly(vinylmethylketone), poly(vinylacetate) or poly(vinylbutyral). The coating allegedly provides increased resolution as compared to an uncoated substrate by increasing the adhesion of the transferred ink or dye to the receptor printing sheet. The coating composition is approximately 100% of the recited polymers.

A problem axises with these compositions when the tackiness of the coating is high enough to cause feeding problems and jamming of the printer due to adhesion either between receptor sheets, or between the receptor sheets and the printer rollers. High tackiness can also result in excessive wax transfer from the donor which, in the case of transfer of single pixels, results in unacceptable half tone images due to bridging of individual half tone dots. Excess tackiness also results in fingerprinting and blocking.

Problems also can arise due to electrical charge build-up on the sheets. This build-up can occur during convening, jogging of film stacks and during film transport in the printer during the printing process. Such build up can cause misfeeds, printer jams, and multiple sheet feeding due to static cling.

U.S. Pat. No. 5,169,468, issued to Graphics Technology International, Inc., also provides a receptor sheet for wax thermal mass transfer printing using polymeric materials for the image receptor layer. The '468 patent teaches the use of a poly(alkylvinylether) and another polymer having a higher glass transition temperature which results in good image quality. The receptor sheet described does not perform as well as one might like when a high speed printer is used.

U.S. Pat. No. 4,686,549, issued to 3M Company, relates to a receptor (i.e., acceptor) sheet having a wax-compatible image receptive layer. This layer has a critical surface tension higher than that of the donor sheet, to aid in wetting the image receptive layer, and a Vicat softening temperature (as measured by ASTM D1525 (1982))of the polymers forming the image receptive layer of at least 30° C. up to 90° C. to prevent tackiness of the receptor sheet at room temperature. At softening temperatures below 30° C., according to this patent, problems arise such as fingerprinting and blocking of stacked film. The image receptive layer according to the '549 patent may contain a blend of wax and various polymers.

Polymeric coatings with a 30° C. to 90° C. softening point generally do have the advantage of minimal handling problems, as suggested by the above patent. The disadvantage is that such coatings are suitable for use only with selected combinations of printers and donor sheets. If, for example, the melting point of the wax on the donor sheet is above a specified maximum for a given printer, an insufficient amount of wax may be transferred to the receptor sheet. Likewise, if the particular printer does not provide sufficient heat energy, the heat transfer from the donor sheet to the receptor sheet, via the wax, may not increase the tackiness of the image receptive layer sufficiently for adhering the wax to the receptor sheet, even if the wax does melt sufficiently for transfer. The result is, inter alia, poor fine line reproduction. It has also been found that when high speed printers are used with the image receptive layers of U.S. Pat. No. 4,686,549, these receptive layers with a softening point of 30° C. to 90° C. do not provide adequate print quality.

A receptor sheet, particularly one applicable for wax thermal transfer printing, which can avoid the foregoing problems often encountered with the use of polymerics and other materials previously tried for acceptor/receptor sheets would be of great value to the industry.

Accordingly, it is an object of the present invention to provide a receptor sheet for wax thermal transfer printing having improved wax receptivity.

It is still another object of the present invention to provide a receptor sheet for wax thermal transfer printing which is particularly adapted to faithful reproduction of pixel dot image formation.

It is another object of the present invention to provide a receptor sheet for wax thermal transfer printing which provides wider printing latitude.

It is still another object of the present invention to provide a receptor sheet for thermal imaging which has a reduced tendency to jam the printing mechanism.

It is another object of the present invention to provide a novel receptor sheet for mass transfer imaging.

It is yet another object of the invention to provide an receptor sheet, as above, which maintains the above characteristics yet which can be used with high speed printers.

These and other objects of the present invention will become apparent upon a review of the following specification and the claims appended thereto.

SUMMARY OF THE INVENTION

The foregoing objectives are achieved by a receptor sheet for receiving donor material in an imagewise fashion by means of mass transfer printing wherein the receptor sheet comprises a substrate and a coating with a glass transition temperature below about 25° C. The coating is comprised of a wax or, preferably, a mixture of wax and a polymer. In a preferred embodiment, the polymer is an acrylic polymer or a polyurethane. In a most preferred embodiment, the coating also contains colloidal silica, amorphous silica, or a combination thereof.

In another embodiment of the invention, a method for forming an image on a receptor sheet for mass transfer printing is provided. The method comprises applying heat to a donor sheet in a selective imagewise fashion by means of a high speed printer, the donor sheet including a substrate layer and a layer of color-containing material, the color-containing material being softened at selected locations on the layer due to the heat application. At least a portion of the softened color-containing material is transferred and adhered to the receptor sheet, thereby forming an image on the receptor sheet. The receptor sheet comprises a substrate and a coating comprising a wax, wherein the coating has a glass transition temperature below about 25° C. A donor sheet-receptor sheet system is also provided.

The objects of the invention are further achieved by a method of forming a receptor sheet comprising coating an emulsion containing wax onto a substrate, and then drying the coating to obtain a film with a glass transition temperature below about 25° C. In a preferred embodiment, the wax emulsion is mixed with a polymer prior to coating the substrate.

DETAILED DESCRIPTION OF THE PREFERRED EMBODIMENTS

The receptor sheets of the present invention provide superior mass transfer printing properties, particularly in high speed printers. Previously used receptor sheets have been found to provide inadequate print quality when used with high speed printers such as the Tektronix® Phaser 200 printer as compared with conventional thermal transfer printers, such as the QMS ColorScript® 200, and the Fargo Primera® printer. These high speed printers provide an increased processing speed of about one-third that of conventional printers, e.g. about 30 seconds compared to about 90 seconds in conventional printers. It is believed that additional energy is required during the high speed processing which has been found to have a detrimental effect on the previously used receptor sheets. Surprisingly, the receptor sheets of the present invention with coatings having a low glass transition temperature provide superior wax receptivity and printing quality during wax thermal transfer printing compared to these previously used receptor sheets. The receptor sheets of the present invention provide good print quality with both conventional printers and high speed printers despite the additional energy required by the high speed printers.

Although the reason for this superior performance is not known since all materials with low glass transition temperatures do not necessarily provide this superior performance with high speed printers, it has now been found that the coatings of the present invention containing wax, and preferably wax and a polymer, provide desirable properties for use with all printers and particularly with high speed printers. Even though the softening point of the coating on the receptor sheet is low, the receptor sheet of the present invention displays acceptable handling characteristics such as little or no fingerprinting or blocking and a minimal tendency for jamming of the printing mechanism.

The wax of the present invention can be any wax with a low glass transition temperature. When the wax is used alone, the glass transition temperature should be below about 25° C. When the wax is used in combination with other materials, the glass temperature of the resulting coating should remain below about 25° C. Waxes which are useful in the present invention include paraffin wax, microcrystalline wax, beeswax, camauba wax and synthetic hydrocarbon waxes. Preferred waxes include those which can be used in an aqueous emulsion for easier coating of the substrate material. In a preferred embodiment, the wax is a polyethylene wax which may be coated onto the substrate as an aqueous polyethylene wax emulsion. In the most preferred embodiment, the wax is Jonwax® 26, provided as a polyethylene wax emulsion by S. C. Johnson with a glass transition temperature after coating on a substrate of about −16° C.

The receptor sheet of the present invention preferably will contain a wax and a polymer. The combination of wax and polymer should provide a coating with a glass transition temperature below about 25° C. The overall glass transition temperature, $T_g$, of the coating should be below about 25° C.; however, since there is no formula for accurately predicting $T_g$ values of mixtures, actual $T_g$ values are determined by direct measurement. In general, if the softening points of the materials individually are less than 25° C., the softening point of the mixture will be correspondingly low.

In general, it is believed that any polymer with a low glass transition temperature will be useful for incorporation with the wax into the receptor sheets of the present invention. These polymers may include acrylic polymers, polyesters, polymethacrylates, polyvinylacetates, polyethylene adipate, polybutadiene, polyurethanes, or compatible mixtures thereof with low glass transition temperatures. The preferred acrylic polymers are the styrenated acrylic emulsions available from S. C. Johnson under the trademark Joncryl®. The preferred polyurethanes are fully reacted aliphatic polyester-based polyurethane compounds, such as those produced by the Mace company.

The weight ratio of wax to polymer used in the coating generally ranges from about 2:1 to about 12: 1. When the polymer is an acrylic polymer, the weight ratio of wax to polymer preferably will be from about 3:1 to about 7:1, most preferably about 3:1.

When the polymer used in the coating is a polyurethane, the weight ratio of wax to polyurethane preferably will be about 2:1 to about 10:1. In a preferred embodiment, the ratio of wax to polyurethane is 10:1. The amount of polyurethane solids which can be in the mixture depends generally on the type of film to be made. For example, for clear films, the amount of polyurethane solids should not be above about 33% of the total solids in the receptor sheet coating. More than 33% polyurethane solids may cause haze above about 5%, which is the industry standard for acceptable haze. For opaque films where haze is not a critical parameter, the amount of polyurethane solids which can be used is up to about 75% of the total solids. Use of a greater amount of polyurethane solids may result in film blocking.

In a preferred embodiment, the coating of the receptor sheet of the present invention will also comprise colloidal silica, amorphous silica or a combination thereof.

The colloidal silicas appropriate for the practice of the present invention can be any appropriate colloidal silica. Those preferred are colloidal silicas presently available from E. I. DuPont de Nemours and from Nalco Corporation. The colloidal silicas useful in this invention generally range in size from about 4 to about 75 nanometers, are negatively charged and treated with cationic sodium or ammonium counterions. The surface areas of the colloidal silicas range from about 40 to about 750 $m^2/Gm$. The following Table lists several suitable colloidal silicas available from Nalco Corporation and their physical/chemical characteristics.

about 90:10 to about 30:70 wax or wax/polymer to silica. Preferably, the ratio of wax or wax/polymer to colloidal silica will be from about 80:20 to about 40:60.

Amorphous silicas, generally of a larger particle size than colloidal silica, may be added to the coating formulation to prevent excessive clinging of the sheets or coating offset of the film during storage, e.g., blocking of master rolls. The amorphous silica generally is used in a small amount such as from about 0.018% to about 0.25% for transparent films. However, greater amounts may be used if the film remains clear. Preferably, the amorphous silica is used in an amount of at least about 0.022% of the total solids in transparent films. The amorphous silica may be used in an amount up to about 2.0% for opaque films or films for which clarity is not an important factor.

The coating of the receptor sheet can also contain conventional fillers and additives. A volatile defoamer and wetting agent, e.g., ethanol, can be added to the coating mix if desired for foam control and improved wettability of the film substrate. Other particulate additives may also be added if desired.

A transparent coating generally has a Gardner Haze value of from about 2 to about 15%, with from about 2 to about 10% being preferred, and with about 2 to about 5% being most preferred. The transparent coating generally is very thin, and is preferably from about 0.005 to 0.05 mils, and most preferably from about 0.01 to about 0.03 mils in thickness. The amount of coating material generally comprises less than 0.2 lbs. per 1000 square feet of receptor sheet. It is preferred that the amount of coating material applied be from about 0.01 to about 0.1 lbs. per 1000 square feet, with about 0.03 to 0.05 lbs. per 1000 square feet being most preferred. Once the coating is heavy and thick enough to approach 0.25 lbs. per about 1000 square feet or more, transparency begins to be lost, i.e., the Gardner Haze value becomes unacceptable. It has also been found that such heavy coatings can NALCO COLLOIDAL SILICAS
General Product Information
(Typical Values Only)

| | Product: | | | | | | | | | | |
|---|---|---|---|---|---|---|---|---|---|---|---|
| | Nalco ® 1115 | Nalco ® 2326 | Nalco ® 1130 | Nalco ® 1030 | Nalco ® 1140 | Nalco ® 1034A | Nalco ® 1040 | Nalco ® 2327 | Nalco ® 1050 | Nalco ® 1060 | Nalco ® 2329 |
| Particle Size (nm) | 4 | 5 | 8 | 13 | 15 | 20 | 20 | 20 | 20 | 60 | 75 |
| Surface Area (M2/gm) | 750 | 600 | 375 | 230 | 200 | 150 | 150 | 150 | 150 | 50 | 40 |
| % Silica (as SiO2) | 15 | 15 | 30 | 30 | 40 | 34 | 40 | 40 | 50 | 50 | 40 |
| pH (@ 25° C.) | 10.5 | 9.0 | 10.0 | 10.2 | 9.7 | 2.8 | 9.0 | 9.3 | 9.0 | 8.5 | 8.4 |
| Specific Gravity | 1.10 | 1.09 | 1.21 | 1.20 | 1.29 | 1.23 | 1.29 | 1.29 | 1.39 | 1.39 | 1.29 |
| Viscosity (Centipoise) | <10 | <10 | <10 | <10 | 15 | <10 | 15 | 20 | 55 | 15 | 10 |
| Stabilizing Ion | Sodium | Ammonium | Sodium | Sodium | Sodium | — | Sodium | Ammonium | Sodium | Sodium | Sodium |
| Approx. $Na_2O$, % | 0.75 | 0.02 | 0.45 | 0.50 | 0.45 | 0.04 | 0.45 | 0.08 | 0.40 | 0.35 | 0.30 |
| Surface Charge | Negative | Negative | Negative | Negative | Negative | Slightly Negative | Negative | Negative | Negative | Negative | Negative |

The colloidal silica is used in a mixture with the wax and/or the polymers of the present invention. The presence of the colloidal silica is believed to help overcome problems with electric charge build up and has been found to allow better transport of the receptor sheet through the printer.

The colloidal silica generally will be used with the wax or wax/polymer mixture in a weight ratio of from surprisingly lack adhesion to the film substrate and lack cohesive strength, i.e., the coating begins to fall off in flakes.

The substrate for the receptor sheet upon which the coating is coated is a film comprising a polymer such as polypropylene, polycarbonate, polysulfone, polyvinylchloride, cellulose acetate, cellulose acetate butyrate, or a polyester. Paper or paper-like materials, however, can also be used as a substrate. Examples of suitable substrates are MYLAR, commercially available from E. I. DuPont de Nemours; MELINEX, commercially available from Imperial Chemical Industries; HOSTAPHAN, commercially available from American Hoechst; polycarbonates, especially LEXAN; cellulose triacetates and the like. In general, the selection of the substrate composition is dictated by the particular and ultimate use of the receptor sheet. In addition to transparent substrates, there can be used opaque or colored substrates in which one or more pigments or dyes are included in the substrate composition. One skilled in the art can readily select the appropriate substrate composition for use in the present invention.

The receptor sheet can be prepared by introducing the ingredients for making the coating into suitable solvents, mixing the resulting solutions at ambient temperature, then coating the resulting mixture onto the substrate and drying the resulting coating. The coating can be coated on the substrate by any coating method known to those of skill in the art, such as knife coating, roll coating, air knife coating, curtain coating, etc. In a preferred method, the wax is applied as an aqueous wax emulsion. The emulsion generally will contain the wax, water and a small amount of soap or emulsifier. After drying, the wax and the emulsifier are left on the substrate. It is believed that the small amount of emulsifier present serves to help spread the wax emulsion onto the substrate.

When a polymer or other components are to be used with the wax, the wax emulsion and additional components generally will be mixed to form a mixture prior to coating on the substrate. It is preferred that the polymer and other components chosen are compatible with the wax or wax emulsion to be employed.

In one embodiment of the invention, a backing sheet may be applied to one side of the substrate as an aid in the printing process. This is advantageous when the receptor sheet is used in conjunction with certain thermal transfer printers having a complicated paper feed path which places limitations on the stiffness of the substrate. The preferred substrate thickness with respect to meeting the limitations on thickness is about 50 microns. However, the print heads of certain printers are also sensitive to substrate thickness, and for printing purposes the optimum thickness is about 125 microns. This caliper would, however, be too stiff for feeding. To circumvent this problem, in a preferred embodiment the present invention provides for a backing sheet attached to the substrate. The backing sheet can be paper, synthetic paper such as filled biaxially oriented polypropylene, polyester film or coated polyester. Synthetic paper is preferred because of its greater dimensional stability on exposure to changes in temperature and humidity. Also, a higher coefficient of friction between the back of the receptor sheet and the synthetic backing sheet is achieved which prevents slippage between the two films during the printing process. Slippage can result in misregistration of colors, misfeeding or jamming in the printer.

In a highly preferred embodiment employing a backing sheet, a polyester substrate is used having a thickness of 50 microns with a 75 to 80 micron synthetic paper backing sheet. The backing sheet can be attached via an adhesive.

While the receptor sheet of the present invention finds unique applicability to wax thermal transfer printing, many other useful applications are possible for this unique receptor sheet. The sheet can be used in many types of mass transfer imaging techniques, e.g., for toner receptive techniques such as laser printers, color copiers, various monochrome xerographic copiers, etc., and phase change ink jet printing. Particular advantageous applicability has been found for the receptor sheet with imaging techniques involving the transfer of a wax mass or a toner mass. The receptor sheet of the present invention has been found to be especially useful when used in conjunction with high speed printers, such as the Tektronix ® Phaser 200.

In a preferred embodiment, the receptor sheet of the invention is used in a method of thermal wax transfer printing comprising applying heat to a donor sheet in selective imagewise fashion in a high speed printer, the donor sheet including a substrate layer and a layer of color-containing material with the color-containing material being softened at selected locations on the layer due to the application of the heat. Suitable donor sheets are well-known and may be selected based upon the image desired. The color-containing material can be a dye or pigment and a wax. Suitable waxes include paraffin wax, beeswax, candalilla wax, and combinations thereof. At least a portion of the softened color-containing material is transferred and adhered to the receptor sheet, forming an image on the receptor sheet.

The following examples illustrate the invention. It is understood, however, that these examples are not to be interpreted as limiting the scope of the invention. All percentages in the examples, and elsewhere in the specification, are by weight unless otherwise specified.

EXAMPLES

For purposes of the following examples, Joncryl ® 74, Joncryl ® 80, Joncryl ® 87, Joncryl ® 89, Joncryl ® 91, Joncryl ®99, Joncryl ®134, Joncryl ® 540, Joncryl ® 585 and Joncryl ® 624 are all non-film forming dispersed styrenated acrylic polymers available from S. C. Johnson, Racine, Wis.

San-Sil ® KU-33 is an amorphous silica sold by PPG Industries, Pittsburgh, Pa.—about 2.5 microns in size.

Eastman AQ38D is a film forming anionic dispersed polyester resin supplied by Eastman Chemicals.

70% polymethyl vinyl ether is sold by BASF chemicals.

Kimdura 80 paper is sold by Kimberly Clark.

EXAMPLE 1

The follow mixture was prepared:

| | |
|---|---|
| Jonwax ® 26 (25% solids) | about 48.0% |
| Water | about 33.8% |
| San-Sil KU-33 | about 0.2% |

This mixture was coated onto a Hoechst Diafoil 4507 prebonded polyester base (3.8 rail) with a #4 Mayer Rod. The film was dried for 1 minute at 170° F. to obtain a dry coating weight of 0.10 lbs/1000 sq. ft. The dried film was cut to 8.5"×12.3" and attached on the back to 3.2 rail thick Kimdura 80 synthetic paper backing sheet. The attachment was made with a ⅛ inch wide two sided coated tape placed 1 inch from the leading edge of the short axis of the 8.5"×12.3" backing sheet.

This film was printed on a Tektronix ® Phaser 200 wax thermal transfer printer equipped with a three pass color transfer roll. The self test printing pattern was made following the instructions in the Tektronix® Phaser 200i user manual on page 67. This pattern enabled the evaluation of pantone colors, alignment, fine pixel printing, tonal quality, bridging, grey scale, pixel drop off, proper alignment of colors and fine wire modelling. One a scale of 1 to 4 where 1 is excellent and 4 is poor, the resulting test printing pattern was a 1, or excellent.

COMPARATIVE EXAMPLE 1

The following formulation as taught in U.S. Pat. No. 5,169,468 was prepared and coated as described in Example 1:

| | |
|---|---|
| water | 24.32 grams |
| ethanol | 36.47 grams |
| 25% Eastman AQ38D (polyester, $T_g$ = 38° C.) | 37.32 grams |
| BASF 70% PMVE (poly(methylvinyl-ether) in toluene) | 1.67 grams |
| San-Sil KU-33 (amorphous silica) | 0.22 grams |

The resulting film was printed on a Tektronix® Phaser 200 wax thermal transfer printer equipped with a three pass color transfer roll as in Example 1. The resulting test printing pattern was inferior to that obtained in Example 1. On a scale of 1 to 4 where 1 is excellent and 4 is poor, the test print rating for this film was 4.

COMPARATIVE EXAMPLE 2

The following formulation not containing wax and using a polymer with a high glass transition temperature was prepared and coated as in Example 1:

| | |
|---|---|
| water | 27.31 grams |
| ethanol | 24.56 grams |
| Joncryl ®87 (styrenated acrylic polymer - Tg = 100) | 14.79 grams |
| Nalco 2326 (colloidal silica) | 33.01 grams |
| Sansil ® KU-33 (amorphous silica) | 0.30 grams |

The resulting film was printed on a Tektronix® Phaser 200 wax thermal transfer printer equipped with a three pass color transfer roll as in Example 1. The resulting test printing pattern was inferior to that obtained in Example 1. On a scale of 1 to 4 where 1 is excellent and 4 is poor, the test print rating for this film was 4.

COMPARATIVE EXAMPLE 3

The following polymers with low glass transition temperatures (at solids with water) were evaluated and compared to the Jonwax® 26 in the above example 1 using the same procedures described in example 1:

| | | Self test print result | |
|---|---|---|---|
| Polymer | Glass Trans. Temp | (overall) | (best color) |
| Joncryl ®74 | −16° C. | poor | cyan |
| Joncryl ®80 | −30° C. | poor | cyan |
| Joncryl ®91 | 10° C. | poor | none |

-continued

| | | Self test print result | |
|---|---|---|---|
| Polymer | Glass Trans. Temp | (overall) | (best color) |
| Joncryl ®99 | −7° C. | poor | none |
| Joncryl ®540 | 20° C. | poor | none |
| Joncryl ®585 | −20° C. | poor | none |
| Joncryl ®624 | −30° C. | poor | cyan |
| AQ38D | 38° C. | poor | magenta |

Although the receptor sheets of the present invention with low glass transition temperatures comprising a substrate and a wax provide excellent print quality, polymers with low glass transition temperatures used alone resulted in a poor overall image.

EXAMPLE 2

The following mixtures were prepared and coated as in Example 1 to compare individual low glass transition temperature polymers in combination with wax in a ratio of 3:1 (3 parts wax/1 part polymer) at 10% total solids (water being the diluent):

| 3 parts | 1 part | overall self test print result |
|---|---|---|
| Jonwax ® 26 | AQ38D ($T_g$ = 38° C.) | good |
| Jonwax ® 26 | Joncryl ®74 ($T_g$ = −16° C.) | good/excellent |
| Jonwax ® 26 | Joncryl ®80 ($T_g$ = −30° C.) | excellent |
| Jonwax ® 26 | Joncryl ®540 ($T_g$ = 20° C.) | good |

EXAMPLE 3

The following mixtures were prepared and coated as in Example 1 to assess the print performance of a wax-/acrylic polymer combination (diluent being water):

| # parts Jonwax ® 26 | # parts Joncryl ® 80 | self test print result |
|---|---|---|
| 1 | 1 | fair/good |
| 3 | 1 | excellent |
| 5 | 1 | excellent |
| 7 | 1 | excellent |
| 9 | 1 | fair/good |
| 12 | 1 | fair |

EXAMPLES 4–13

The following mixes were prepared and coated by the method of Example 1. Three Nalco colloidal silicas, 2326, 2327 and 2329 were used in varying ratios of wax to silica. The type of silica and the ratio of wax to silica is shown in the top row of Table 1. The amounts in weight percent of each element in the composition are also listed in Table 1. The wax used was Jonwax® 26 with 25% solids. The Nalco colloidal silica 2326 had 14.5% solids and the 2327 and 2329 silicas had 30% solids.

The coatings obtained by the formulations of examples 4-13 were tested on a Tektronix® Phaser 200 wax thermal transfer printer equipped with a three pass color transfer roll as in Example 1. The test print rating for each example is at the bottom of Table 1 where 1=excellent; 2=good; 3=fair; and 4=poor.

TABLE 1

| | Ex. 4 0% silica | Ex. 5 2326 80/20 | Ex. 6 2326 60/40 | Ex. 7 2326 40/60 | Ex. 8 2327 80/20 | Ex. 9 2327 60/40 | Ex. 10 2327 40/60 | Ex. 11 2329 80/20 | Ex. 12 2329 60/40 | Ex. 13 2329 40/60 |
|---|---|---|---|---|---|---|---|---|---|---|
| JONWAX ® 26 | 48.0 | 38.40 | 28.80 | 19.20 | 38.40 | 28.80 | 19.20 | 38.40 | 28.80 | 19.20 |
| WATER | 33.8 | 29.28 | 24.77 | 20.24 | 34.84 | 36.88 | 36.92 | 34.84 | 35.88 | 36.92 |
| NALCO SILICA | 0.0 | 16.55 | 33.10 | 49.66 | 8.00 | 16.00 | 24.00 | 8.00 | 16.00 | 24.00 |
| ETHANOL | 18.2 | 15.77 | 13.33 | 10.90 | 18.76 | 18.32 | 19.88 | 18.76 | 19.32 | 19.88 |
| TEST PRINT RATING | 2.00 | 2.00 | 1.00 | 2.00 | 1.00 | 2.00 | 2.00 | 2.00 | 1.00 | 2.00 |

This example showed that wax in conjunction with colloidal silicas also provided a superior overall print image (See Table 1). However, the level of colloidal silica added is important for the overall print quality result. Film transport through the Tektronix ® Phaser 200 printer appeared to be better than in formulations without colloidal silica.

COMPARATIVE EXAMPLE 4

3M film CG3630, believed to have been made according to U.S. Pat. No. 4,686,549, was tested on a Tektronix ® Phaser 200 wax thermal transfer printer equipped with a three pass color transfer roll as in Example 1. The test print rating according to the scale given in Examples 4–13 was a 4.

EXAMPLES 14–23

The following mixtures were prepared and coated as in Example 1 to evaluate a wax/polymer formula in a ratio of 7:1 wax to polymer in combination with colloidal silica. The type of silica and the ratio of wax/polymer to silica is shown in the top row of Table 2. The amounts in weight percent of each element in the composition are also listed in Table 2. The wax used was Jonwax ® 26 with 25% solids. The Nalco colloidal silica 2326 had 14.5% solids and the 2327 and 2329 had 30% solids. The styrenated acrylic polymer Joncryl ® 80 had 46% solids.

The coatings obtained by the formulations of examples 14–23 were tested on a Tektronix ® Phaser 200 wax thermal transfer printer equipped with a three pass color transfer roll as in Example 1. The test print rating for each example is at the bottom of Table 2 where 1=excellent; 2=good; 3=fair; and 4=poor.

TABLE 2

| | Ex. 14 0% 0% | Ex. 15 2326 80/20 | Ex. 16 2326 60/40 | Ex. 17 2326 20/80 | Ex. 18 2327 80/20 | Ex. 19 2327 60/40 | Ex. 20 2327 40/60 | Ex. 21 2329 80/20 | Ex. 22 2329 60/40 | Ex. 23 2329 40/60 |
|---|---|---|---|---|---|---|---|---|---|---|
| WATER | 43.68 | 39.29 | 34.90 | 31.09 | 44.28 | 44.88 | 45.47 | 44.28 | 44.88 | 45.47 |
| JONWAX ® 26 | 35.00 | 28.00 | 21.00 | 14.00 | 28.00 | 21.00 | 14.00 | 28.00 | 21.00 | 14.00 |
| JONCRYL ® 80 | 2.60 | 2.08 | 1.58 | 1.04 | 2.08 | 1.56 | 1.04 | 2.08 | 1.56 | 1.04 |
| NALCO SILICA | 0.00 | 13.79 | 27.59 | 40.54 | 6.67 | 13.33 | 20.00 | 6.67 | 13.33 | 20.00 |
| ETHANOL | 18.72 | 16.84 | 14.96 | 13.33 | 18.98 | 19.23 | 19.49 | 18.98 | 19.23 | 19.49 |
| TEST PRINT RATING | 2.00 | 2.00 | 2.00 | 2.50 | 2.00 | 2.50 | 2.50 | 2.00 | 2.00 | 2.50 |

This example showed that colloidal silica did not enhance print performance but did, however, appear to improve the transport characteristics through the Tektronix ® Phaser 200 printer.

EXAMPLES 24–27

The following mixtures were prepared and coated as in Example 1 to evaluate wax in combination with a fully reacted aliphatic polyester-based polyurethane compound. The ratio of wax to polyurethane is listed in the first row of Table 3. The amounts of the elements in the formulation for each example are also listed in Table 3. The wax was Jonwax ® 26 with 25% solids, the polyurethane was Mace GH6120 ($T_g$=15° C.) with 36% solids and the amorphous silica was Sansil ® KU-33 with 100% solids.

The coatings obtained by the formulations of examples 24–27 were tested on a Tektronix ® Phaser 200 wax thermal transfer printer equipped with a three pass color transfer roll as in Example 1. The test print rating for each example is at the bottom of Table 3 where 1=excellent; 2=good; 3=fair; and 4=poor.

TABLE 3

| | Ex. 24 Jonwax ® 26/GH6120 2:1 | Ex. 25 Jonwax ® 26/GH6120 7.3:1 | Ex. 26 Jonwax ® 26/GH6120 10:1 | Ex. 27 Jonwax ® 26/GH6120 1:0 |
|---|---|---|---|---|
| WATER | 11.21 | 10.99 | 10.70 | 10.50 |
| JONWAX ® 26 | 6.67 | 7.69 | 9.09 | 10.00 |
| GH6120 (Polyurethane) | 2.31 | 1.60 | 0.63 | 0.00 |
| ETHANOL | 4.81 | 4.72 | 4.58 | 4.50 |
| SANSIL ® KU-33 | 0.05 | 0.05 | 0.05 | 0.05 |
| TEST PRINT | 1.00 | 1.00 | 1.50 | 2.00 |

TABLE 3-continued

| | Ex. 24 Jonwax ® 26/GH6120 2:1 | Ex. 25 Jonwax ® 26/GH6120 7.3:1 | Ex. 26 Jonwax ® 26/GH6120 10:1 | Ex. 27 Jonwax ® 26/GH6120 1:0 |
|---|---|---|---|---|
| RATING | | | | |

This example showed that a polyurethane compound provided superior print quality. San-Sil ® KU-33 was added to the above as an antiblock agent because the polyurethane is very tacky and would result in blocking/pickoff in roll form. In order to sustain a clear coating (less than 5% haze), the level of GH6120 (in combination with the Jonwax ® 26) should not exceed 33% of total solids. The addition of up to 75% GH6120 in solids in combination with the Joriwax ® 26 showed superior print quality as well; however, the haze was too high for clear coatings of less than 5% haze. These coatings would be adequate for opaque substrates such as ICI 339 polyester.

San-Sil ® KU-33, OK412, or Syloid 620 also was found useful for the prevention of blocking/pickoff.

Various modifications and alterations of this invention will become apparent to those skilled in the an without departing from the scope and spirit of this invention, and it should be understood that this invention is not to be unduly limited to the illustrative embodiments set forth herein.

What is claimed is:

1. A receptor sheet for receiving donor material in imagewise fashion by means of mass transfer printing comprising a substrate and a coating comprised of wax, wherein the coating has a glass transition temperature below about 25° C.

2. The receptor sheet of claim 1, wherein the polymer is a styrenated acrylic polymer or a polyurethane.

3. The receptor sheet of claim 2, wherein the coating further comprises colloidal silica, amorphous silica, or a combination thereof.

4. The receptor sheet of claim 1, wherein the coating further comprises colloidal silica, amorphous silica, or a combination thereof.

5. The receptor sheet of claim 1, wherein the wax to polymer ratio is about 3:1.

6. The receptor sheet of claim 5, wherein the polymer is a styrenated acrylic polymer with a glass transition temperature of about −30° C.

7. The receptor sheet of claim 6, wherein the wax is a polyethylene wax.

8. The receptor sheet of claim 1, wherein the mass transfer printing is conducted in a high speed printer.

9. A receptor sheet for receiving donor material in imagewise fashion by means of mass transfer printing comprising a substrate and a coating comprised of wax and an acrylic polymer, with the wax to acrylic polymer ratio being in the range of from about 3:1 to about 7:1, and wherein the coating has a glass transition temperature below about 25° C.

10. The receptor sheet of claim 9, wherein the coating is further comprised of colloidal silica, amorphous silica or a combination thereof.

11. A method for forming an image on an receptor sheet for mass transfer printing, comprising:

applying heat to a donor sheet in selective imagewise fashion by means of a high speed printer, the donor sheet including a substrate layer and a layer of color-containing material, the color-containing material being softened at selected locations on the layer due to said heat application; and transferring and adhering at least a portion of the softened color-containing material to the receptor sheet, thereby forming an image on the receptor sheet, wherein the receptor sheet comprises a substrate and a coating with a glass transition temperature of below about 25° C. comprised of a wax.

12. The method of claim 11, wherein the coating is further comprised of a polymer.

13. The method of claim 12, wherein the polymer is a styrenated acrylic polymer or polyurethane.

14. The method of claim 12, wherein the coating is further comprised of colloidal silica, amorphous silica or a combination thereof.

15. A donor sheet-receptor sheet system comprised of a donor sheet comprising a substrate layer and a layer of color-containing material and a receptor sheet comprising a substrate and a coating comprised of wax, wherein the coating has a glass transition temperature below about 25° C.

16. The donor sheet-receptor sheet system of claim 15, wherein the color-containing material is comprised of a wax and a dye or a pigment.

17. The donor sheet-receptor sheet system of claim 15, wherein the coating is comprised of a mixture of wax and a polymer.

18. The donor sheet-receptor sheet system of claim 17, wherein the polymer is a styrenated acrylic polymer or a polyurethane.

19. The donor sheet-receptor sheet system of claim 17, wherein the coating further comprises colloidal silica, amorphous silica, or a combination thereof.

* * * * *